United States Patent [19]

Avril

[11] 4,175,335

[45] Nov. 27, 1979

[54] MACHINE FOR DRYING GRANULAR MATERIALS

[76] Inventor: Arthur C. Avril, P.O. Box 17087, Cincinnati, Ohio 45217

[21] Appl. No.: 858,618

[22] Filed: Dec. 8, 1977

[51] Int. Cl.[2] ..... F26B 11/04

[52] U.S. Cl. ..... 34/128; 34/129; 34/137; 366/144; 366/228; 432/106; 432/114

[58] Field of Search ..... 34/128, 135, 136, 137, 34/129; 366/57, 144, 145, 228; 432/106, 112, 114, 118, 197; 165/89, 90, 91

[56] References Cited

U.S. PATENT DOCUMENTS

| | | | |
|---|---|---|---|
| 1,370,085 | 3/1921 | Burman | 34/137 |
| 2,618,865 | 11/1952 | Arnold | 34/128 |

FOREIGN PATENT DOCUMENTS

| | | | |
|---|---|---|---|
| 355845 | 7/1922 | Fed. Rep. of Germany | 34/135 |

*Primary Examiner*—John J. Camby
*Assistant Examiner*—Larry I. Schwartz
*Attorney, Agent, or Firm*—James W. Pearce; Roy F. Schaeperklaus

[57] ABSTRACT

A machine for drying granular materials such as sand and gravel. The machine includes coaxial inner and outer cylinders. Moist sand is introduced into an inlet end of the inner cylinder and gravel is introduced into the inlet end of the outer cylinder. The sand is moved along the inner cylinder by impellers toward the outlet end of the inner cylinder in heat exchange relation with the inner cylinder while the sand is heated to evaporate water therefrom. The heated sand is directed from the outlet end of the inner cylinder into an inlet end portion of the outer cylinder to mix with the gravel. Impeller assemblies mounted on the interior of the outer cylinder raise the sand-gravel mixture as the cyliners rotate to cause the sand-gravel mixture to advance along a space between the cylinders toward the outlet end of the outer cylinder and to cascade against an outer wall of the inner cylinder. Catch plate assemblies mounted on the outer wall of the inner cylinder and extending outwardly therefrom catch the sand-gravel mixture as the sand-gravel mixture cascades against the outer wall of the inner cylinder to hold the sand-gravel mixture in heat exchange relation to the inner cylinder as the cylinders revolve so that an outlet end portion of the inner cylinder can heat the sand-gravel mixture to a sufficient temperature that moisture in the gravel is caused to evaporate, and the sand-gravel mixture is cooled by the moist sand in an inlet end portion of the inner cylinder as the sand-gravel mixture advances to the discharge end of the outer cylinder. The cylinders are driven by a chain which runs on a sectional sprocket mounted on the outer cylinder. Sections of the sectional sprocket are separately mounted on the outer cylinder so that the outer cylinder can flex with changes of temperature of portions thereof.

9 Claims, 20 Drawing Figures

FIG. 4
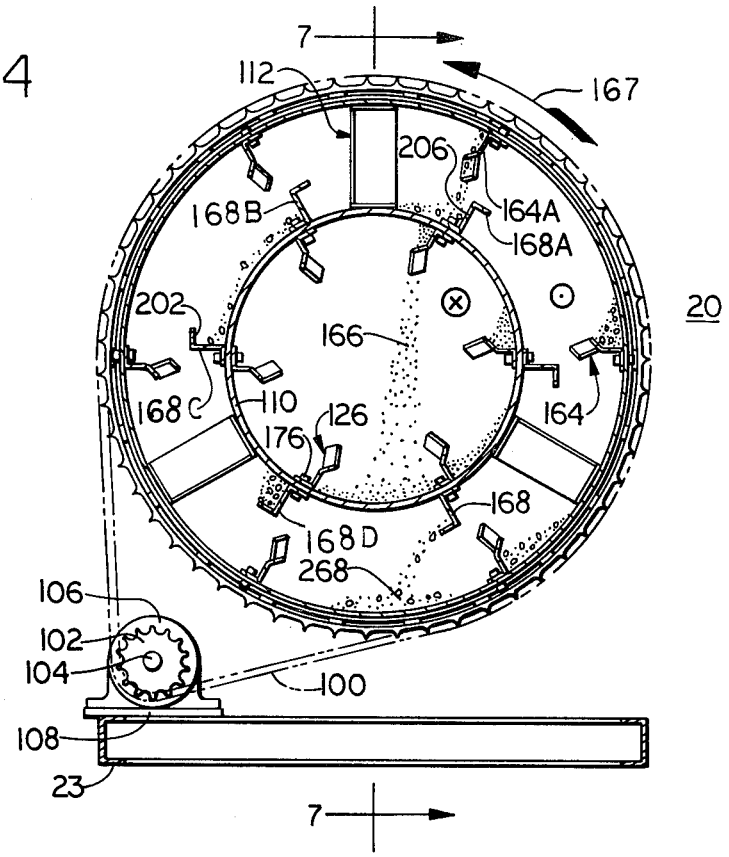
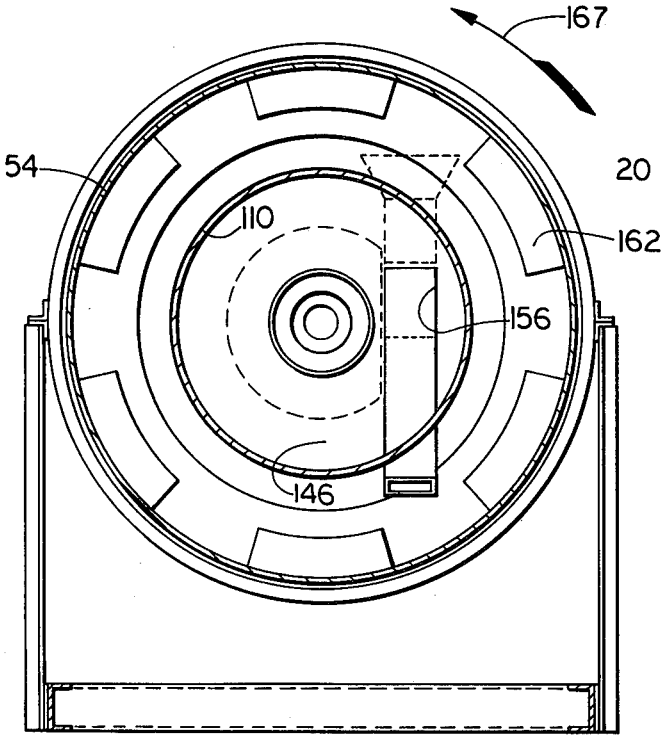
FIG. 5

FIG. 6
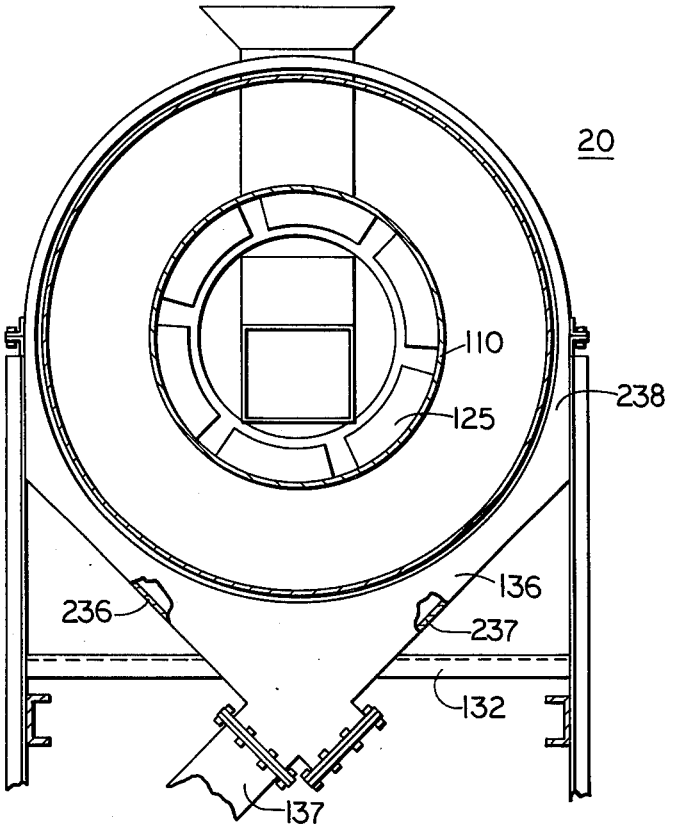
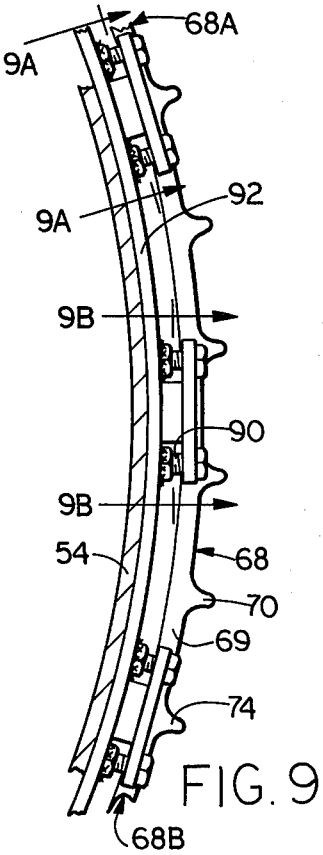
FIG. 9
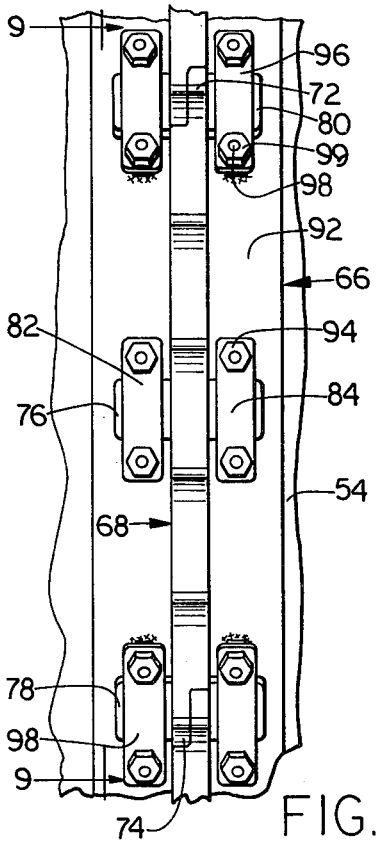
FIG. 8
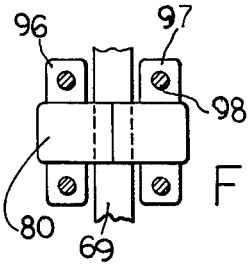
FIG. 9A
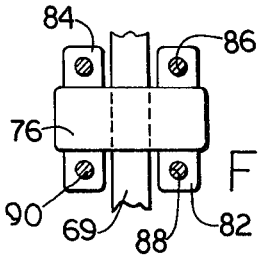
FIG. 9B ⊙ ROTATION
20
7A
7A
110
112
114
116
118
120
122
123
124
125
126
127
134
136
137
138
140
142
146
148
150
152
154
155
158
160
162
164
168
236
238

190
186
164
188
192
196

180
178
170
126
172

126
180

14
180
178
126
172

202
168
198
200
204

16
194
190
192
164
186
180

178
126
12
180
182
170

13
180
170
172
176
174
126
178

MACHINE FOR DRYING GRANULAR MATERIALS

This invention relates to a machine for drying and mixing granular materials. More particularly, this invention relates to a machine for drying sand and gravel for use in manufacture of premixed packaged concrete and for mixing the sand and gravel.

The machine represents an improvement over the type of machine shown in my co-pending application Ser. No. 652,632 filed Jan. 26, 1976 now abandoned and in my U.S. Pat. No. 3,514,870. Such a machine can include two coaxial cylinders. Sand, which can carry entrained water, can enter one end of the inner cylinder and progress along the inner cylinder in a first direction to be discharged into the outer cylinder. Gravel can be introduced into the outer cylinder and is mixed with the sand to form a sand-gravel mixture which progresses along the outer cylinder with the sand in an opposite direction. Heating gases can be projected into the inner cylinder. The gases heat the sand in the inner cylinder to evaporate the water therefrom.

An object of this invention is to provide such a machine which includes means for holding the contents of the outer cylinder in heat exchange relation with the wall of the inner cylinder as the cylinders rotate so that an outlet end portion of the inner cylinder can heat the sand-gravel mixture to eliminate moisture therefrom, and the moist sand in an inlet end portion of the inner cylinder can cool the sand-gravel mixture as the mixture progresses along the outer cylinder.

A further object of this invention is to provide such a machine in which catch plate members are mounted on the outer wall of the inner cylinder to catch contents of the outer cylinder as the cylinders rotate to hold the contents of the outer cylinder against the wall of the inner cylinder.

A further object of this invention is to provide such a machine in which impeller members mounted on the inner wall of the outer cylinder raise the material in the outer cylinder as the cylinders rotate and direct the material onto the catch plate members as the impeller members approach an uppermost position.

A further object of this invention is to provide an improved drive for such a machine.

A further object of this invention is to provide a drive for such a machine which includes a segmental gear mounted on the outside of the outer cylinder and means running on the segmental gear for driving the segmental gear to rotate the cylinders.

Briefly, the invention provides a drying machine which includes a pair of coaxial cylinders which are mounted to turn together. Sand, which can contain moisture, can be introduced into one end of the inner cylinder. Impeller members are mounted on the inside of the wall of the inner cylinder and act to advance the sand along the interior of the inner cylinder to an opposite end thereof at which the sand falls into the space between the outer and inner cylinders. Heating gases are directed into the inner cylinder at this opposite end, and products of combustion can be removed at the end at which the sand enters. Gravel can be introduced into the space between the inner and outer cylinders at the opposite end to be mixed with the sand. Impeller members mounted on the interior of the outer cylinder raise the sand-gravel mixture and pour the mixture against the inner cylinder while advancing the mixture toward the end at which sand enters. Catch plate members mounted on the outer wall of the inner cylinder catch the mixture to hold the mixture against the wall of the inner cylinder so that, as the mixture starts along the space between the cylinders, the mixture can be heated by the contents of the inner cylinder and, as the mixture proceeds further along the space, the mixture is cooled by the wet sand in the inner cylinder as the sand is heated to vaporize the moisture. The mixture is discharged from the space between the cylinders at the sand entry end. The catch plates can extend radially of the inner cylinder and can be provided with circumferentially extending flanges at outer edges thereof which hold the mixture on each catch plate until the catch plate approaches the bottom of its swing as the cylinders rotate. The outer cylinder is rotatably mounted. The outer cylinder carries a segmental gear mounted on the outer wall thereof. Each segment of the segmental gear includes an arcuate body with spaced teeth thereon. Transverse bars mounted on each arcuate body can be overlaid by mounting bars which are mounted on the outer wall of the outer cylinder and the transverse bars can move slightly circumferentially to permit adjustment for varying temperatures of the outer cylinder. Each tooth at an end of the segment can be a half-tooth to cooperate with an end tooth of an adjacent segment.

The above and other objects and features of the invention will be apparent to those skilled in the art to which this invention pertains from the following detailed description and the drawings, in which:

FIG. 4 is a view in section taken on the line 4—4 in FIG. 1;

FIG. 5 is a view in section taken on the line 5—5 in FIG. 1;

FIG. 6 is a view in section taken on the line 6—6 in FIG. 1;

FIG. 8 is a fragmentary top plan view of a portion of the machine looking in the direction of the arrows 8—8 in FIG. 1;

FIG. 9 is a view in section taken on the line 9—9 in FIG. 8;

FIG. 9A is a view in section taken on the line 9A—9A in FIG. 9;

FIG. 9B is a view in section taken on the line 9B—9B in FIG. 9;

In the following detailed description and the drawings, like reference characters indicate like parts.

Figure 1:
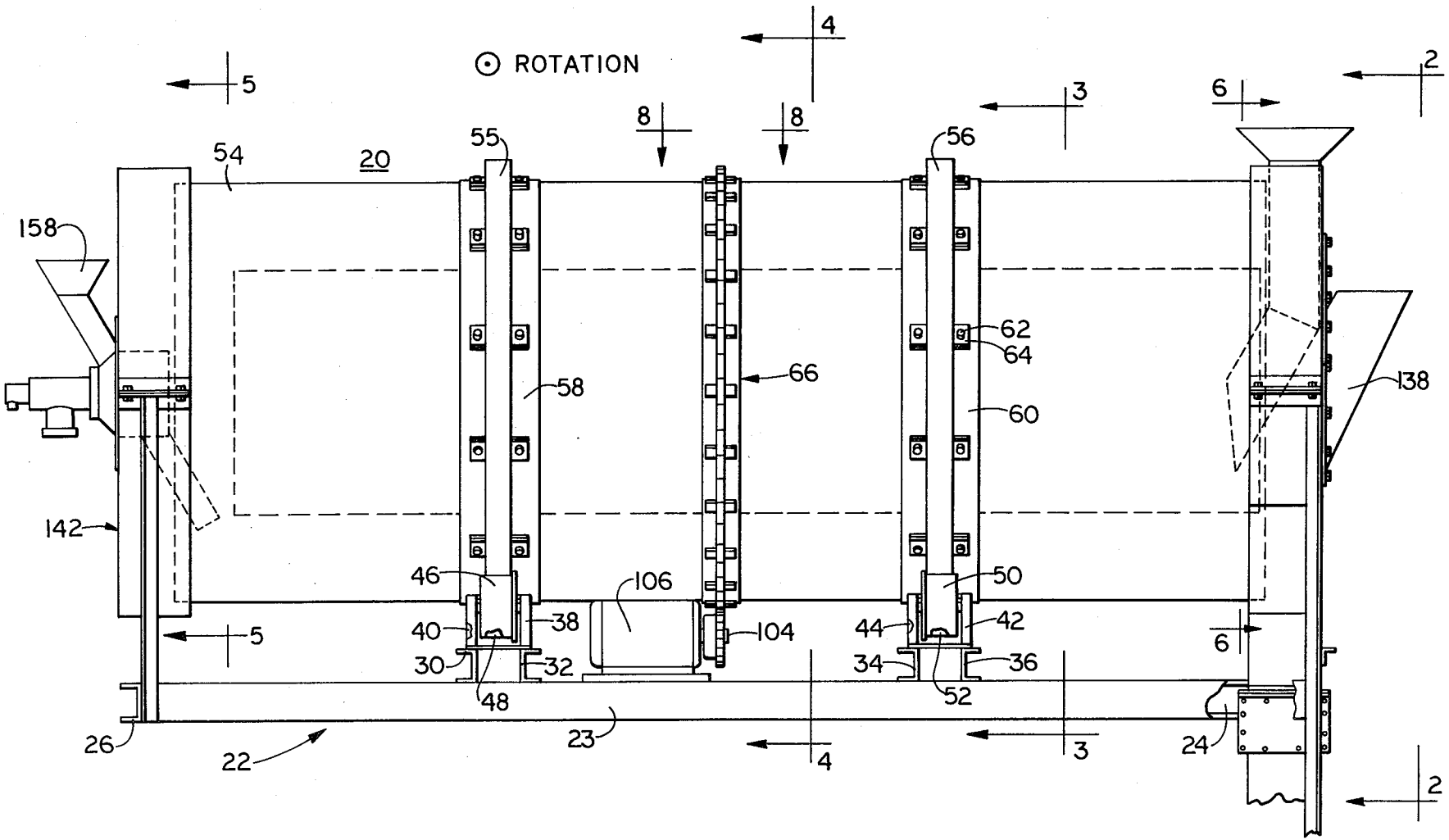
FIG. 1 is a view in side elevation of a drying and mixing machine constructed in accordance with an embodiment of this invention, a portion of a discharge chute being shown in association therewith.
Figure 2:
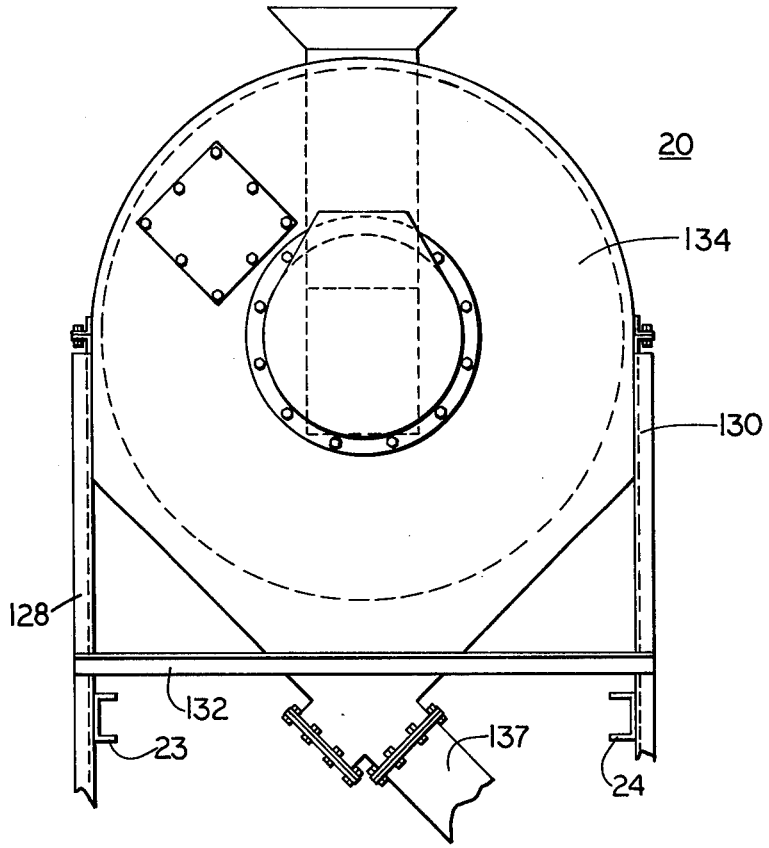
FIG. 2 is a view in end elevation of the machine shown in FIG. 1 looking in the direction of the arrows 2—2 in FIG. 1.

In FIGS. 1–7 inclusive is shown a drying machine 20 constructed in accordance with an embodiment of this invention. The machine 20 is supported on a framework 22, which includes lengthwise main frame members 23 and 24 and crosswise main frame members 26, only one of which is shown. Cross beams 30, 32, 34 and 36 span the main frame members 26 and 28 and support roller frames 38, 40, 42 and 44. Rollers 46, 48, 50 and 52 are rotatably supported on the roller frames 38, 40, 42 and 44, respectively. The rollers 46, 48, 50 and 52 rotatably support a main cylinder 54. Ring-shaped track members 55 and 56 are mounted on reinforcing rings 58 and 60, respectively. The reinforcing rings 58 and 60 can be attached to the outside wall of the main cylinder 54, as by welding. Appropriate fasteners 62 extend through openings (not shown) in lugs 64 attached to the track members 54 and 56 and through openings (not shown) in spacer bars 65, in the reinforcing rings 58 and 60 and in the main cylinder 54 to mount the track members 55 and 56 on the main cylinder 54. The track members 55 and 56 are rotatably supported by roller pairs 46–48 and 50–52, respectively.

A sectional sprocket 66 is mounted on the main cylinder 54 between the track members 55 and 56. As shown in FIGS. 8 and 9, the sectional sprocket 66 includes a plurality of similar sprocket sections, three of which are indicated at 68, 68A and 68B. The sprocket section 68 includes an arcuate body 69 on which are formed four full teeth 70 and two half-teeth 72 and 74 at ends thereof. Each of the half-teeth cooperates with a half-tooth on an adjacent section to form a single sectional tooth. The section 68 also includes a central transverse attachment bar 76 and a pair of transverse attachment half-bar portions 78 and 80. End portions of the central attachment bar 76 are held by plates 82 and 84. Each of the plates 82 and 84 is provided with a pair of openings 86 and 88 through which studs 90 extend. The studs 90 are attached to a ring 92 that is attached to the outside wall of the main cylinder 54, as by welding. Nuts 94 mounted on the studs 90 hold the plates 82 and 84 in tight engagement with the end portions of the central attachment bar 76. Similar plates 96 and 97 overlie the half-bar portions 80 and 78 and are held in place in a similar manner by studs 98 and nuts 99 mounted on the studs 98. A drive chain 100 (FIG. 4) runs on the sectional sprocket 66 and on a sprocket 102. The sprocket 102 is carried by a drive shaft 104 which is driven by a motor 106. The motor 106 is carried on a mounting plate 108 that is, in turn, supported on the lengthwise main frame member 23. The mounting arrangement of the sections of the sectional sprocket permit slight circumferential movement of the plates as necessary to accommodate changes in temperature of the wall of the outer cylinder.

Figure 3:
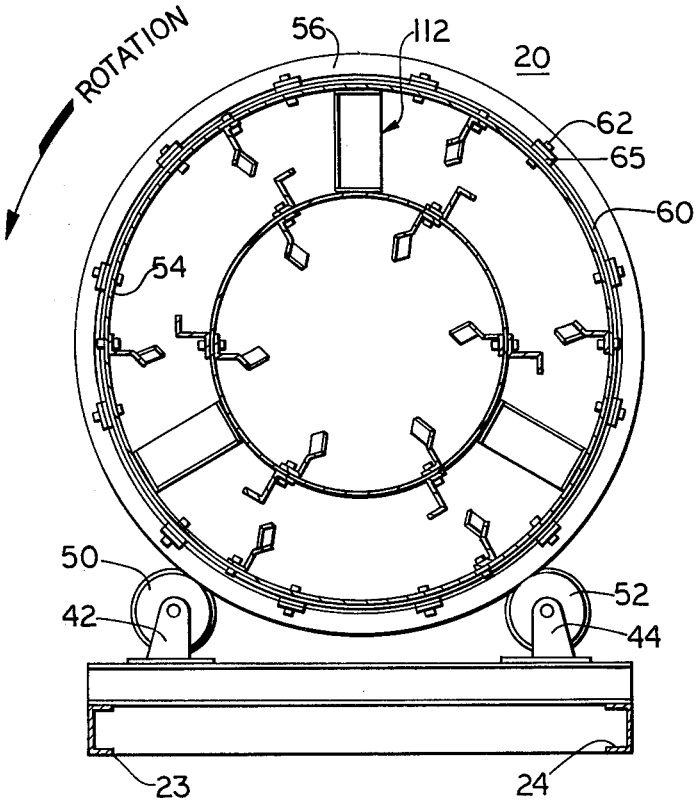
FIG. 3 is a view in section taken on the line 3—3 in FIG. 1.
Figures 7, 7A:
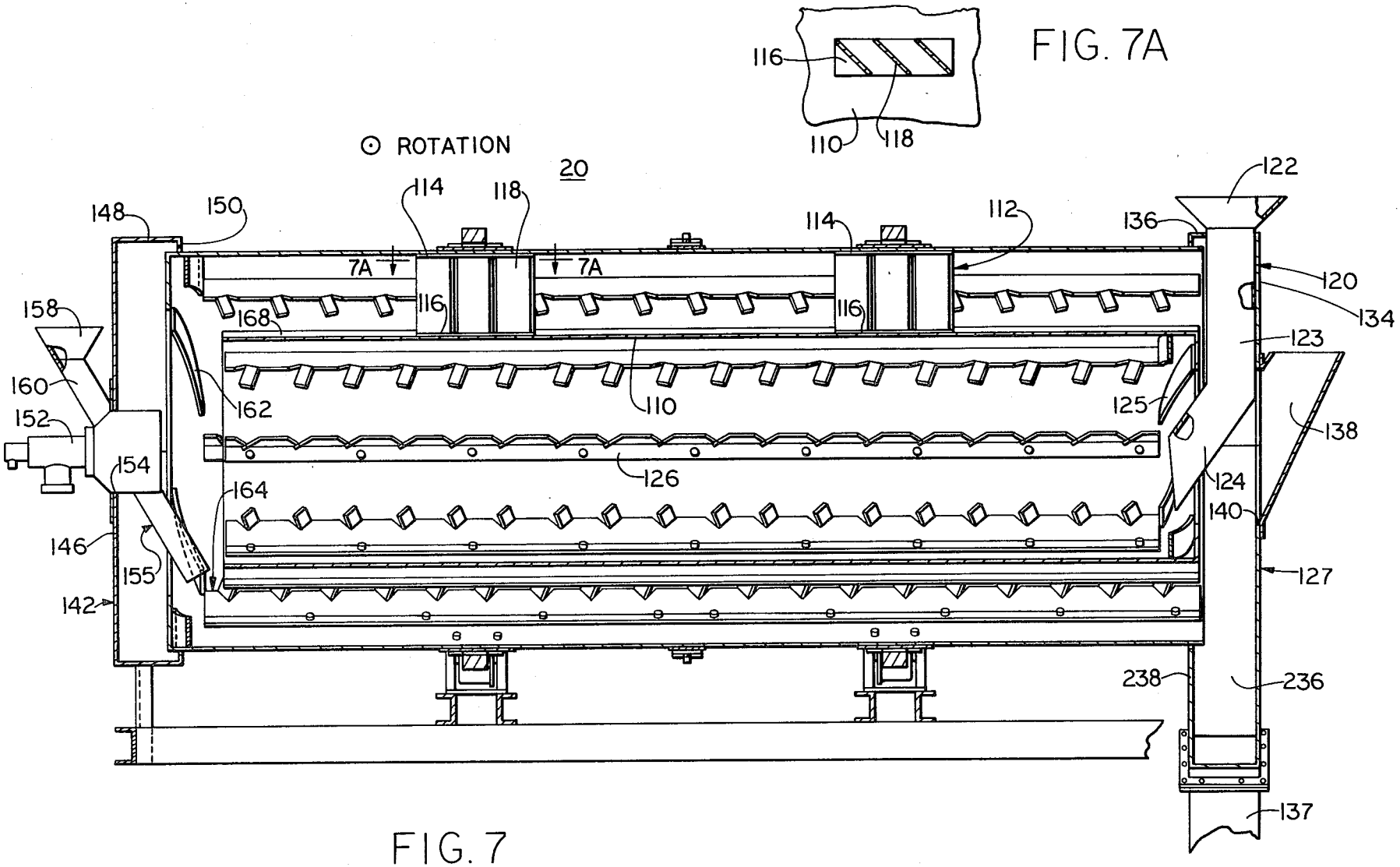
FIG. 7 is a view in section taken on the line 7—7 in FIG. 4.
FIG. 7A is a view in section taken on the line 7A—7A in FIG. 7.

A hollow inner cylinder 110 is mounted inside the main cylinder 54 in coaxial relation therewith. Spacer assemblies 112 (FIGS. 3, 4 and 7) hold the inner cylinder 110 and the main cylinder 54 in spaced coaxial relation. Each of the spacer assemblies 112 includes an outer plate 114 attached to an inner wall of the main cylinder 54, an inner plate 116 attached to an outer wall of the inner cylinder 110, and a plurality of vanes 118 which span the inner and outer plates 114 and 116. The vanes 118 are angled as shown in FIG. 7A so that, as the cylinders 54 and 110 rotate counterclockwise as shown in FIG. 3, any particulate material in the space between the main and inner cylinders which is picked up by the vanes is discharged to the right as shown in FIG. 7.

Sand is introduced into the right hand end of the inner cylinder 110 through a hollow chute 120. The chute 120 includes a funnel portion 122 into which the sand is introduced, a hollow vertical portion 123, and a sloping portion 124, which discharges the sand into the interior of the inner cylinder 110. The sand can contain water which is removed in the drying and mixing machine. Helical vanes 125 mounted on the interior of the inner cylinder 110 advance the sand to impeller assemblies 126.

The chute 120 is mounted inside an end housing 127. The end housing 127 is supported on upright angle members 128 and 130 carried by the lengthwise main frame members 23 and 24, respectively. A cross bar 132 links the upright angle members 128 and 130. The end housing 127 includes a plate portion 134, which overlies the right hand end of the main cylinder 54 as shown in FIG. 7. The end housing 127 also includes a half-cylindrical flange 136, which overlies the upper portion of the right hand edge of the main cylinder 54, sloping catch plates 236 and 237, which underlie the right hand edge of the main cylinder 54, and a vertical flange portion 238, which terminates in closely spaced relation to the outer wall of the main cylinder 54. A discharge chute 137 carried by the end housing 127 receives particulate material discharged from the right hand end of the main cylinder. A vent stack 138 mounted on the plate 134 and communicating with a central opening 140 in the plate 134 permits discharge of products of combustion from the inner cylinder 110.

At the left hand end of the main cylinder 54 is mounted a heater housing 142. The heater housing 142 includes a plate portion 146, which overlies the left hand end of the main cylinder 54, a ring portion 148, which overlies the left hand edge of the main cylinder 54, and an inwardly directed flange 150. The inner edge of the flange 150 is spaced from the outer wall of the main cylinder 54 to permit entry of ambient air. A burner 152 is mounted in a central opening 154 of the plate portion 146 and can project hot combustion gases into the interior of the inner cylinder 110. The burner 152 can burn natural gas or any flammable volatile liquid or gas.

A gravel chute 155 is mounted on and extends through an opening 156 in the plate portion 146. The gravel chute 154 includes a funnel portion 158, into which the gravel is introduced, and a tubular portion 160, which discharges into the interior of the main cylinder 54. Helical vanes 162 mounted on the interior of the main cylinder 54 advance the gravel to impeller assemblies 164.

The impeller assemblies 126 in the inner cylinder 110 serve to advance sand 166 (FIG. 4) to the left as shown in FIG. 7 along the inner cylinder 110 as the cylinders 54 and 110 rotate in the direction indicated by the arrow 167 in FIG. 5 while causing the sand to cascade across the inner cylinder 110 as shown in FIG. 4 as the products of combustion from the burner 152 pass along the interior of the inner cylinder 110 to heat and dry the sand as the sand moves along the inner cylinder toward the left hand end (FIG. 7) thereof. When the sand reaches the left hand end of the inner cylinder 110, the heated and dried sand falls into the main cylinder 54 where the sand is mixed with the gravel that enters through the gravel chute 155 to form a sand-gravel mixture 268. The sand-gravel mixture is propelled to the right and caused to cascade across the space between the inner cylinder 110 and the main cylinder 54, as shown in FIG. 4, by the impellers 164 and as the sand-gravel mixture cascades against the inner cylinder 110, catch plate assemblies 168 catch and hold the sand-gravel mixture against the outer face of the inner cylinder 110 so that the sand-gravel mixture 268 is cooled as it advances along the space between the inner cylinder 110 and the main cylinder 54. An appropriate exhaust fan (not shown) can be connected to the vent stack 138 for drawing air through the space between the inner and outer cylinders to aid in cooling the sand-gravel mixture. The fan can divert the air and stack gases to appropriate pollution control devices (not shown).

The impeller assemblies can be of the type shown in my U.S. Pat. No. 3,514,870. Details of construction of one of the impeller assemblies 126 are shown in FIGS. 10–14 inclusive. The assembly 126 includes an elongated body 170, a flange 172 provided with openings 174 for fasteners 176 along one edge of and at a right angle to the body 170, and a sloping flange 178 along an opposite edge of the body 170. Angled vanes 180 are mounted in slots 182 in the sloping flange 178 and are angled as shown so that, as the sand drops therefrom, the sand is advanced along the interior of the inner cylinder 110. The fasteners 176 extend through openings (not shown) in the inner cylinder 110 and serve to attach the impeller assembly 126 to the interior of the wall of the inner cylinder 110 and to attach one of the catch plate assemblies 168 to the exterior of the wall of the inner cylinder 110.

Figures 10, 11, 12, 13, 14, 15, 16, 17:
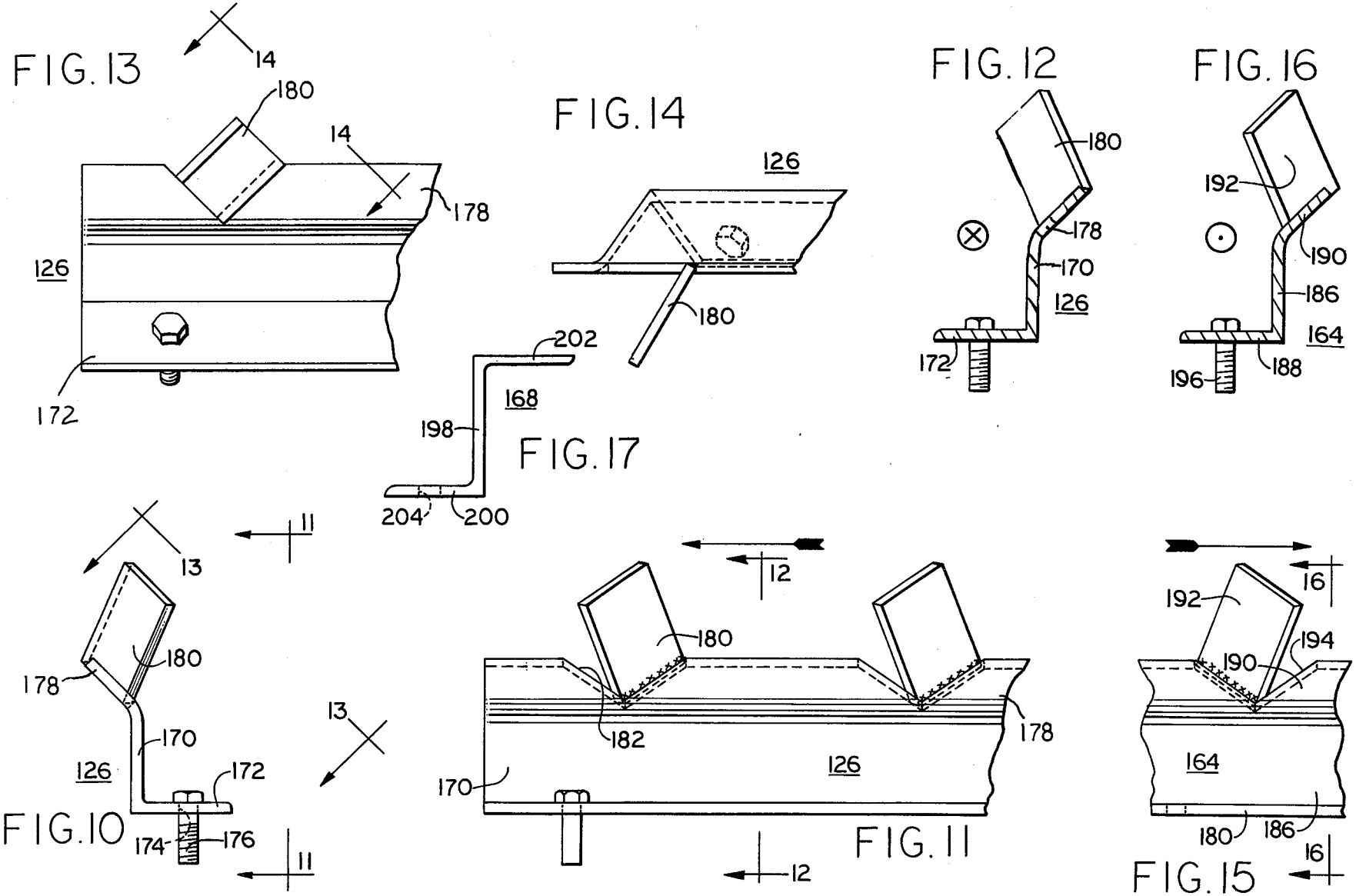
FIG. 10 is a view in end elevation of an impeller assembly of the machine, an attachment bolt being shown in association therewith.
FIG. 11 is a fragmentary view in side elevation of the impeller assembly shown in FIG. 10 looking in the direction of the arrows 11—11 in FIG. 10.
FIG. 12 is a view in section taken on the line 12—12 in FIG. 11.
FIG. 13 is a view taken in the direction of the arrows 13—13 in FIG. 10.
FIG. 14 is a view taken in the direction of the arrows 14—14 in FIG. 13.
FIG. 15 is a fragmentary view in side elevation of a second impeller assembly of the machine.
FIG. 16 is a view in section taken on the line 16—16 in FIG. 15.
FIG. 17 is a view in end elevation of a catch plate assembly of the machine.

Details of construction of one of the impeller assemblies 164 are shown in FIGS. 15 and 16. The impeller assembly 164 is generally similar to the impeller assembly already described except for reversal of parts and includes an elongated body 186, a flange 188 provided with openings along one edge of and at a right angle to the body 186, and an angled flange 190 along an opposite edge of the body 186. Angled vanes 192 are mounted in slots 194 in the angled flange 190. Fasteners 196 extend through the openings in the flange 188 and through openings (not shown) in the main cylinder 54 to attach the impeller assembly 164 to the interior of the wall of the main cylinder 54.

Details of construction of one of the catch plate assemblies 168 are shown in FIG. 17. The catch plate assembly 168 is of generally Z-shape in cross section and includes an elongated body or plate portion 198, an attachment flange 200 and a material catching flange 202. The attachment flange 200 is provided with spaced openings 204 which receive the fasteners 176 associated with one of the impellers 126 to attach the catch plate assembly to the outer wall of the inner cylinder 110 as shown in FIG. 4 with the plate portion 198 extending radially of the inner cylinder and the material holding flange 202 extending tangentially thereof in trailing direction. As shown in FIG. 7, the catch plate assembly 168 is coextensive in length with the inner cylinder 110.

As the inner and outer cylinders rotate, the sand-gravel mixture 268 is picked up by the impellers 164 as shown in FIG. 4 and cascades against the cylinder 110 and the catch plate assemblies 168 to be carried by the catch plate assemblies 168 and the inner cylinder 110 in position for heat exchange with the wall of the inner cylinder 110 so that, as the sand-gravel mixture approaches the discharge chute 137, the wet sand on the interior of the inner cylinder 110 serves to cool the wall of the inner cylinder and to cool the sand-gravel mixture before it is discharged.

As shown in FIG. 4, the flanges 202 of the catch plate assemblies hold the sand-gravel mixture in engagement with or in close proximity to the inner cylinder until almost the bottom of the swing of each catch plate assembly, whereupon the sand-gravel mixture falls to the main cylinder to be picked up again by the impeller assemblies 164. As shown in FIG. 4, each of the impeller assemblies 164 is mounted a little in advance of an associated one of the catch plate assemblies so that, as an impeller assembly at the position 164A approaches the top of its swing, it directs the sand-gravel mixture against the inner cylinder 110 and against a leading face 206 of an associated catch plate assembly at the position 168A so that the catch plate assembly at the position 168A catches and holds the sand-gravel mixture in heat exchange relation with the inner cylinder 110. As the catch plate assembly approaches a position 168B, the sand-gravel mixture slides along the inner cylinder 110 to another catch plate assembly at the position indicated at 168C, which holds the sand-gravel mixture as the cylinders rotate until the catch plate assembly reaches a position 168D and, as the cylinders rotate further, the sand-gravel mixture falls from the catch plate assembly to the main cylinder 54.

The catch plate assemblies prevent fall of the sand-gravel mixture against the backs or trailing faces of the impeller assemblies 164, which could cause improper advance of the sand-gravel mixture, and the sand-gravel mixture is deposited by the catch plate assemblies on the interior of the outer cylinder near the bottom of the swing thereof in position to be picked up by leading faces of the impeller assemblies 164.

The sand enters the machine at its storage temperature and is heated to a sufficient temperature, such as 270°–300° F., to cause evaporation of water carried by the sand and so that, when the sand is mixed with the gravel, any water carried by the gravel is also evaporated. The burner can be mounted at either end of the inner cylinder, but preferably is mounted, as shown, at the end where the sand in the inner cylinder reaches its maximum temperature for best exchange of heat. The sand-gravel mixture can leave the machine barely warm, as at a temperature of 120°–140° F. The cylinders, impeller assemblies and catch plate assemblies can be formed of steel or the like. The sand-gravel mixture leaving the machine can be used as it leaves the machine, or the mixture can be separated into different sizes to be recombined as required.

The drying machine illustrated in the drawings and described above is subject to structural modification without departing from the spirit and scope of the appended claims.

Having described my invention, what I claim as new and desire to secure by Letters Patent is:

1. A machine for drying and mixing sand and gravel which comprises an outer cylinder having an inlet end and an outlet end, an inner cylinder having an inlet end and an outlet end, the inner cylinder being mounted inside of and coaxially with the outer cylinder, the inlet end of the outer cylinder being adjacent the outlet end of the inner cylinder, the outlet end of the outer cylinder being adjacent the inlet end of the inner cylinder, means for rotating the cylinders in unison, means for introducing moist sand into the inlet end of the inner cylinder, means for introducing gravel into the inlet end of the outer cylinder, means for moving the sand along the inner cylinder toward the outlet end of the inner cylinder in heat exchange relation with the inner cylinder, a burner at the outlet end of the inner cylinder directing products of combustion into the outlet end of the inner cylinder to pass therealong and heat the moist sand in the inner cylinder to evaporate water therefrom, a vent stack communicating with the inlet end of the inner cylinder for receiving and discharging the products of combustion, means for directing the heated sand from the outlet end of the inner cylinder into an inlet end portion of the outer cylinder to mix with the gravel to form a sand-gravel mixture, impeller assembly means mounted on the interior of the outer cylinder for engaging the sand-gravel mixture to raise the sand-gravel mixture as the cylinders rotate to cause the sand-gravel mixture to advance along a space between the cylinders toward the outlet end of the outer cylinder and to cascade against an outer wall of the inner cylinder, and catch plate assembly means mounted on the outer wall of the inner cylinder and extending outwardly therefrom to catch the sand-gravel mixture as the sand-gravel mixture cascades against the outer wall of the inner cylinder to hold the sand-gravel mixture in heat exchange relation to the inner cylinder as the cylinders revolve.

2. A machine as in claim 1 wherein there is an inlet end portion of the outer cylinder opposed to the outlet end of the inner cylinder and the heated sand falls from the outlet end of the inner cylinder into the inlet end portion of the inner cylinder.

3. A machine as in claim 1 in which the catch plate assembly means includes a plurality of catch plate assemblies and each of the catch plate assemblies includes an elongated plate portion extending radially of the inner cylinder.

4. A machine as in claim 3 wherein each catch plate assembly includes an elongated flange on an outer edge of the elongated plate portion for holding the sand-gravel mixture on the plate portion as the plate portion swings downwardly during rotation of the cylinders.

5. A machine as in claim 3 wherein the impeller assembly means includes a plurality of impeller assemblies and each impeller assembly is mounted in advance of one of the catch plate assemblies and directs the sand-gravel mixture into engagement with the plate portion of that one of the catch plate assemblies as that one of the catch plate assemblies approaches the top of its swinging movement.

6. A machine as in claim 5 wherein the sand-gravel mixture advances along the inner cylinder from that one of the catch plate assemblies to another one of the catch plate assemblies in advance of that one of the catch plate assemblies as that one of the catch plate assemblies passes its highest position.

7. A machine as in claim 6 wherein each catch plate assembly includes an elongated flange on an outer edge of the elongated plate portion and extending in trailing direction therefrom for holding the sand-gravel mixture on the plate portion of the other catch plate assembly as the plate portion of the other catch plate assembly swings downwardly.

8. A machine for drying and mixing granular materials which comprises an outer cylinder having an inlet end and an outlet end, an inner cylinder having an inlet end and an outlet end, the inner cylinder being mounted inside of and coaxially with the outer cylinder, the inlet end of the outer cylinder being adjacent the outlet end of the inner cylinder, the outlet end of the outer cylinder being adjacent the inlet end of the inner cylinder, means for rotating the cylinders in unison, means for introducing a moist first granular material into the inlet end of the inner cylinder, means for introducing a second granular material into the inlet end of the outer cylinder, means for moving the first granular material along the inner cylinder toward the outlet end of the inner cylinder in heat exchange relation with the inner cylinder, a burner at the outlet end of the inner cylinder directing products of combustion into the outlet end of the inner cylinder to pass therealong and heat the first granular material in the inner cylinder to evaporate water therefrom, a vent stack communicating with the inlet end of the inner cylinder for receiving and discharging the products of combustion, means for directing the heated first granular material from the outlet end of the inner cylinder into an inlet end portion of the outer cylinder to mix with the second granular material to form a mixture of granular materials, impeller assembly means mounted on the interior of the outer cylinder for engaging the mixture to raise the mixture as the cylinders rotate to cause the mixture to advance along a space between the cylinders toward the outlet end of the outer cylinder and to cascade against an outer wall of the inner cylinder, and catch plate assembly means mounted on the outer wall of the inner cylinder and extending outwardly therefrom to catch the mixture as the mixture cascades against the outer wall of the inner cylinder to hold the mixture in heat exchange relation to the inner cylinder as the cylinders revolve.

9. A machine for drying and mixing sand and gravel which comprises an outer cylinder having an inlet end and an outlet end, an inner cylinder having an inlet end and an outlet end, the inner cylinder being mounted inside of and coaxially with the outer cylinder, the inlet end of the outer cylinder being adjacent the outlet end of the inner cylinder, the outlet end of the outer cylinder being adjacent the inlet end of the inner cylinder, means for rotating the cylinders in unison, means for introducing moist sand into the inlet end of the inner cylinder, means for introducing gravel into the inlet end of the outer cylinder, means for moving the sand along the inner cylinder toward the outlet end of the inner cylinder in heat exchange relation with the inner cylinder, a burner directing fuel and combustion products thereof to produce a flow of hot products of combustion in the inner cylinder to pass therealong and heat the moist sand in the inner cylinder to evaporate water therefrom, a vent stack communicating directly with the inner cylinder for receiving and discharging the products of combustion, means for directing the heated sand from the outlet end of the inner cylinder into an inlet end portion of the outer cylinder to mix with the gravel to form a sand-gravel mixture, impeller assembly means mounted on the interior of the outer cylinder for engaging the sand-gravel mixture to raise the sand-gravel mixture as the cylinders rotate to cause the sand-gravel mixture to advance along a space between the cylinders toward the outlet end of the outer cylinder to cascade against an outer wall of the inner cylinder, and catch plate assembly means mounted on the outer wall of the inner cylinder and extending outwardly therefrom to catch the sand-gravel mixture as the sand-gravel mixture cascades against the outer wall of the inner cylinder to hold the sand-gravel mixture in heat exchange relation to the inner cylinder as the cylinders revolve.

* * * * *